United States Patent [19]

Dickson et al.

[11] Patent Number: 4,503,085

[45] Date of Patent: Mar. 5, 1985

[54] AMORPHOUS METAL POWDER FOR COATING SUBSTRATES

[75] Inventors: James Dickson, Stirling; Louis F. Nienart, Bloomsbury; David W. Roth, Convent Station, all of N.J.

[73] Assignee: Allied Corporation, Morris Township, Morris County, N.J.

[21] Appl. No.: 464,180

[22] Filed: Feb. 7, 1983

Related U.S. Application Data

[63] Continuation-in-part of Ser. No. 285,730, Jul. 22, 1981, abandoned.

[51] Int. Cl.[3] ..... B05D 1/10; B22F 9/06; C22C 19/08; C22C 33/02

[52] U.S. Cl. ..... 427/34; 427/328; 427/423; 148/403; 75/251

[58] Field of Search ..... 75/0.5 B, 0.5 BA, 0.5 C, 75/122, 123 B, 123 N, 123 J, 123 K, 123 L, 124, 126 R, 238, 251; 427/34, 423, 328; 148/403

[56] References Cited

U.S. PATENT DOCUMENTS

| | | | |
|---|---|---|---|
| Re. 29,989 | 5/1979 | Polk et al. | 148/403 X |
| Re. 30,106 | 10/1979 | Polk et al. | 148/403 X |
| 3,856,513 | 12/1974 | Chen et al. | 75/122 |
| 4,052,201 | 10/1977 | Polk et al. | 75/124 R |
| 4,069,045 | 1/1978 | Lundgren | 75/251 |
| 4,221,587 | 9/1980 | Ray | 75/0.5 C |
| 4,221,592 | 9/1980 | Ray | 75/122 |
| 4,290,808 | 9/1981 | Ray | 75/251 |
| 4,304,593 | 12/1981 | Maeland | 75/0.5 R |
| 4,410,490 | 10/1983 | Ray et al. | 148/403 X |

FOREIGN PATENT DOCUMENTS

| | | | |
|---|---|---|---|
| 54-51919 | 4/1979 | Japan | 148/403 |

OTHER PUBLICATIONS

Ray, Ranjan, "Bulk Microcrystalline Alloys from Metallic Glasses" in *Metal Powder Report,* Jan. 1983, pp. 47–49.

*Metallic Glasses* Papers Presented at a Seminar of the Materials Science Divison of the Amer. Soc. for Metals Sep. 18, and 19, 1976, American Society for Metals, pp. 27–31, TN. 693.M4M37.1976.

Patterson II, et al., "Rapid Solidification Rate Processing and Application to Turbine Engine Materials" *Journal of Metals,* Sep. 1980, pp. 34–39.

Jackson, et al., "Production of Metallurgical Structures by Rapid Solidification Plasma Deposition" *Journal of Metals,* Nov. 1981, pp. 23–27.

*Metal Progress,* Advertisement for Markomet (TM) Alloys as Spray Powders, Jul. 1981, p. 60.

*Primary Examiner*—Teddy S. Gron

*Assistant Examiner*—Matthew A. Thexton

*Attorney, Agent, or Firm*—James Riesenfeld; Gerhard H. Fuchs

[57] ABSTRACT

The present invention is for a flat B containing amorphous powder based in Fe, Ni, Co or a combination thereof; a coating resulting from deposition of the powder; and a method for depositing the powder.

The composition of the powder and the resulting coating consists essentially of the formulation: $(Fe,Ni,Co)_{bal}Cr_{0-20}(Mn,Mo,W)_{0-35}(B,Si,C)_{5-25}(Al,Ti)_{0-10}$ where the subscripts are in atomic percent and with the proviso that $4 \leqq B \leqq 15$, and that the balance will exceed 50%.

7 Claims, No Drawings

AMORPHOUS METAL POWDER FOR COATING SUBSTRATES

CROSS-REFERENCE TO PRIOR APPLICATION

This application is a continuation-in-part of application Ser. No. 285,730, filed July 22, 1981, and now abandoned.

FIELD OF INVENTION

The present invention relates to a powder for coating substrates; and more particularly to an amorphous metal powder, to a method for applying the powder, and to the resulting coating.

PRIOR ART

It has been known that metals can be deposited onto a substrate to produce a coating that provides enhanced wear and corrosion resistance. Metal coatings were frequently made using highly alloyed powders which were fused onto the substrate. The coating produced by these powders was frequently multiphased, and consisted of a hard intermetallic abrasion resistant material in a more ductile matrix.

Many of the prior art powders used to form coating have alloy compositions that can be formed in the amorphous state if the cooling rate is sufficiently rapid. These alloy powders have, however, been produced in the multiphase crystalline state for coating.

U.S. Pat. No. 3,322,546 teaches typical prior art compositions used for coating. The powders of these compositions were obtained by mechanically mixing and blending crystalline powders of various compositions and then processing the mixture to produce crystalline powders. The processed powders produced a coating with a multiphase crystalline structure.

Methods for better homogenizing powders used for coating are taught in U.S. Pat. No. 4,118,527 where the individual crystalline ingredients are physically combined together in intimate contact.

Atomization techniques such as those discussed in U.S. Pat. No. 4,124,737 have been employed to homogenize powders. However, the degree of homogenization obtained by this technique has not been established. The atomized powders of the U.S. Pat. No. 4,124,737 had no strong precipitation formers, such as B, to cause precipitates to form in the coating. For this reason it might be possible to make the alloys into homogeneous powders. It was reported that in order to effectively plasma spray these atomized powders the size should be 325 Tyler mesh or finer.

U.S. Pat. No. 4,192,672 extends the teachings on atomization of powders for coating surfaces to include boron containing alloys. The patent reports that typical atomized spray-and-fused boron containing nickel powders have a distribution of fine borides. The patent goes on to teach that the powders should be 100 Tyler sieve or finer for spray-and-fuse self-fluxing alloys.

The coatings obtained from spraying the powders of the type described above frequently show connected porosity and/or only mechanical interlock between the deposited particles, unless the coatings were given a subsequent fusing heat treatment such as described in the U.S. Pat. No. 4,192,672.

Wear resistance coatings have been deposited on metal surfaces by such techniques as cathode sputtering. One such technique is taught in U.S. Pat. No. 4,124,477. These techniques are only effective in forming very thin coatings, and cannot be used to produce coatings to withstand many types of abrasion wear.

SUMMARY OF INVENTION

The present invention provides an amorphous powder suitable for coating a substrate, a method for applying the powder, and the coating which results from applications of the powder.

The powder of the present invention is a boron-containing alloy based in Ni, Fe, Co, or a combination thereof. The amorphous powder of the present invention is in the form of a flat flake, and is essentially a single phase boride free material. The powder may optionally contain additional metalloids from the group Si and C.

The powder may further contain additions of Mo, W, Mn, Cr, Al, and Ti. In general the powder composition is described as consisting essentially of the following formulation: $(Fe,Ni,Co)_{bal}\ Cr_{0-20}(Mn,Mo,W)_{0-35}(B,Si,C)_{5-25}(Al,Ti)_{0-10}$ with the proviso $4 \leqq B \leqq 15$.

This alloy may contain small additions of the elements V, Zr, and Y, however the maximum for any of these elements should be maintained at less than about 1 atomic percent.

The flat powder of the present invention can be as coarse as −80 mesh. When deposited onto a metal substrate the powder forms an essentially boride-free coating. The coating of the present invention is low in porosity, does not require fusing to attain good adhesion to the substrate, and provides a coating with excellent corrosion resistance.

BEST MODE FOR CARRYING THE INVENTION INTO PRACTICE

The powder of the present invention is amorphous. This powder, as compared to boride containing multiphase powders of similar compositions, has the surprisingly property that it has a "memory of lack of structure". It retains its lack of structure, or amorphous character, through melting in a flame spray and/or plasma spray, and upon subsequent deposit onto a substrate, the structure of the coating formed by these powders is substantially amorphous (e.g. at least 40% amorphous) and free from borides. Both of these features can be determined by x-ray analysis. Not only in the amorphous character of the powder maintained through the deposition process, but also other properties of the material are maintained, such as the hardness. As a result of this "memory" the properties of the coating can be predicted from the properties of the amorphous material.

Additions such as Cr will tend to enhance the corrosion resistance of the powder. Preferably the Cr addition should be between 10 and 20 atomic percent, however, Si will serve as a Cr substitute and allow the reduction of the Cr level to about 5 atomic percent. More preferably, the Cr content is between 5 and 10 atomic percent and Si is at least 5 atomic percent. Mo, W and Mn will increase the strength of the alloy. The sum of these latter metals should be limited to about 35 atomic percent to avoid problems of adherence of the material to the substrate. It is also appreciated that the inclusion of Al and Ti will improve the wetting characteristic of the alloy. These additions are particularly effective when adequate preparation of the surface by such techniques as grit blasting and degreasing are not practiced.

When it is desired to produce a coating with high hardness, it is preferred that the chemistry be further restricted to an alloy having a boron content greater than or equal to about 10 atomic percent.

In order to assure that the powder has an amorphous structure it is preferred that the cooling rate be about $10^6$° C./sec during solidification of the molten metal. This cooling rate is not generally obtainable by atomization techniques. If atomized powders such as those described in the U.S. Pat. No. 4,192,672 are employed, the powders will have at least two phases: a metallic solid solution and a boride. The borides appears to survive the remelting in the torch, and upon deposition produces a boride containing surface. This boride-containing surface is generally softer and less corrosion resistant than the surface produced by an amorphous coating having the same composition.

It is preferred that the powder of the present invention be produced by casting on a moving chill surface to produce an amorphous ribbon, and thereafter fragmenting the ribbon into powder. Methods for reduction of amorphous ribbon to powder are taught in U.S. Pat. Nos. 4,290,808 and 4,304,593 assigned to the assignee of the present invention.

It has been found that the powder of the present invention, when produced from flat ribbon fragments, allows one to select particle size ranges that were not heretofore used without a fusion step. This fusion step would destroy the amorphous character of the resulting surface. It has been found that the flat powder of the present invention can be readily deposited onto a substrate to produce a high density coating using powder as coarse as −80 mesh.

Furthermore, when it is desired to produce a coating with maximum hardness and ductility, it is preferred that the particle size blend be −170 mesh. Preferably, the blend will contain in excess of 50% particles with a size coarser than 270 mesh.

This powder of the present invention made from rapidly solidified ribbon is a clean powder and has a low oxygen content as compared to powders made by other techniques. The reduced oxygen content may minimize the problem of the fluxing of boron and therefore the depletion of boron from the resulting coated surface.

While this powder is typically of lower oxygen concentration than powders produced by other methods, it has been found that the oxygen concentration increases rapidly with decreasing particle size. For example a Ni base alloy having the nominal composition $Ni_{56.5}Fe_{10}Mo_{23.5}B_{10}$ has been found to have the oxygen content as a function of particle size given in Table I.

TABLE I

| Powder Size | |
|---|---|
| −35 mesh | less than 100 ppm |
| −80 mesh | 130 ppm |
| −170 mesh | 210 ppm |
| −325 mesh | 460 ppm |

In order to illustrate the merits of the powder of the present invention, blends having the size distribution given in Table II were sprayed with arc and gas torches.

TABLE II

| | Distribution of Particle Size in Powders | |
|---|---|---|
| | Mesh Ranges | |
| BLEND | Particle Size Range Tyler Sieve | Percentage of Powder within the Range |
| A | −80 to +100 | 15 |
| | −100 to +270 | 65 |
| | −270 to +325 | 15 |
| | −325 | 5 |
| B | −100 to +250 | 100 |
| C | −115 to +200 | 100 |
| D | −250 to +325 | 100 |

The following examples will further illustrate the advantage of the powder of the present invention.

EXAMPLE I

Powder blend A having a nominal composition:

$Fe_{70}Cr_{10}Mo_{10}B_4C_6$ by atomic percent was arc plasma sprayed onto a 4 inch by 4 inch by 0.25 inch mild steel coupon. The coupon surface was blasted with #25 steel grit and subsequently cleaned using a degreasing solvent, 1,1-trichloroethane prior to coating.

The amorphous powder was produced by fracturing ribbon in a jet mill.

The torch used to deposit the powder was an AVCO PG-100 with a 901065-1 anode.

The operating parameters for the torch were as follows:

Voltage: 29 volts
Amps: 860
Power: 25 kw
Carrier Gas and Flow rate: A, 8 cfm
Plasma Gas: A 60 L cfm, He 15 cfm
Distance from torch to substrate: 6 inches The resulting tenacious deposit was 10 mils thick. The deposit was sectioned and there was no indication of interconnected porosity. The hardness of the deposit was in excess of RC #70. The resulting hardness is characteristic of the amorphous state.

EXAMPLE II

Powder blend C having a nominal composition:

$Ni_{56.5}Fe_{10}Mo_{23.5}B_{10}$ by atomic percent was arc plasma sprayed onto a 1.5 inch by 2.5 inch by 0.25 inch mild steel coupon. The coupon surface was blasted with steel grit and degreased with trichloroethylene.

The torch used to deposit the powder was a Metco Gun, type 2MB, with an E type nozzle. The operating parameters were as follows:

Voltage: 70–80 volts
Amps: 400
Carrier Gas for powder: He
Carrier Gas for plasma: $H_2$ 15 cfm, $N_2$ 100 cfm
Gas Pressure: 50 psi
Number of passes of torch: 4
Distance of torch from sample: 4–5 inches The resulting deposit was 12 mils thick. The deposit was sectioned and there was no indication of interconnected porosity. The density of the coating was 90%. The hardness of the surface was 1100 kg/mm$^2$ Vickers with a load of 100 grams. The resulting hardness is characteristic of the amorphous state.

EXAMPLE III

The same torch, material and torch parameters were used as in Example II; however the substrate was a mild steel screen. The resulting hardness was 100 kg/mm$^2$ Vickers with a load of 100 grams. The coating was about 40% amorphous as determined by x-ray analysis.

EXAMPLE IV

Powder blend B having compositions:

$Ni_{60}Mo_{30}B_{10}$ by atomic percent was flame sprayed onto a 1.5 inch by 2.5 inch by 10 gage mild steel coupon.

A Metco Type P oxy-acetylene torch was employed to deposit the powder.

The resulting deposit was about 10 mils thick. The hardness of the deposit was in excess of a Vickers hardness of 1100 kg/mm$^2$ when using 100 gram load. This hardness is characteristic of the amorphous state.

EXAMPLE V

Powder blend D having at least 50% of the particles larger than −270 mesh and having the composition:

$Ni_{57}Cr_{10}Mo_{25}B_8$ by atomic percent was flame sprayed using the same procedure as was used for Example IV.

The resulting deposit was about 10 mils thick. The Vickers hardness of the deposit was 1000 Kg/mm$^2$ with a load of 100 grams. The resulting hardness is characteristic of the amorphous state and is lower than the hardness of Example IV because the boron level in the sample is lower and since their is no carbon to compensate for the reduction in boron.

EXAMPLES VI–XV

Five selected powders were deposited by arc plasma spraying onto Type 304 Stainless Steel, mild steel, and cast iron. The thickness of the deposit was between 8 and 11 mils. These powders were as follows: (1) $Ni_{56.5}Fe_{10}Mo_{23.5}B_{10}$ with a particle size distribution (−250 to +325) 57.5%, (−325) 42.5%; (2) $Ni60Mo_{30}B_{10}$ with a particle size distribution (−250 to +325) 89.88%, (−325) 10.2%; (3) $Ni_5Fe_{68}Cr_{12}Mo_3W_2B_{10}$ with a particle size distribution (−250 to +325) 100%; (4) $Ni_{51.5}Fe_{6.2}Cr_{16.1}Mo_{9.6}W_{1.25}B_{8.9}Si_{2.05}C_{2.4}Mn_1V_{0.4}$ with a particle size distribution (−250 to +325) 100%; and (5) $Ni_{68.8}Fe_{2.2}Cr_{6.6}B_{14.1}Si_{7.5}$ with a particle size distribution (−250 to +325), 71.2% (−325) 28.8%.

The as deposited coatings were well bonded to the substrate and in all cases the coating had a substantially amorphous structure, being about 50% amorphous for the alloy:

$Ni_{51.5}Fe_{6.2}Cr_{16.1}Mo_{9.6}W_{1.25}B_{8.9}Si_{2.05}C_{2.4}Mn_1V_{0.4}$ and substantially higher fraction for all other samples. In all cases the resulting coatings were essentially free from boride precipitates.

EXAMPLES XVI–XVII

A series of tests were made on spraying one of two alloys. These alloys had similar characteristics and their nominal compositions were:

$Ni_{60}Mo_{30}Br_{10}$;

and $Ni_{57.5}Fe_{10}Mo_{23.5}B_{10}$

Powder with each alloy composition was sprayed with two disinct powder blends, one being −170 mesh, and the other being −325 mesh. The −170 mesh blend has a distribution in particle size of (−170 to +270) 80% and (−270) balance.

The surface roughness, microhardness, crystallinity, coating density, and tensile strength are reported in Table III for each of the blends.

The ductility of the coatings for the two blends were checked by depositing a coating of a nominal thickness of 4 mils onto a 60 mil sheet. The coated sheets were then rigidly mounted and a ball indentor depressed approximately ⅓ inch into the coated sheet from the non-coated side. This test resulted in a cup-shaped indentation of the sheet. The coatings were considered to have passed if no flaking or separation of the coating from the substrate could be detected after the testing. The results of this test are reported in Table III under the heading "Ductility Test".

The spraying efficiency for the two blends was determined only for the alloy:

$Ni_{56.5}Fe_{10}Mo_{23.5}B_{10}$.

TABLE III

| | −170 | −325 |
|---|---|---|
| Surface Roughness (μin) | 570 | 300 |
| Microhardness (kg/cm$^2$) | 710 | 640 |
| Crystallinity (% C.I.) | 8.7 | 3.5 |
| Coating Density (% Theoretical) | 97.0 | 98.4 |
| Tensile Bond Strength (psi) | 6400 | 6400 |
| Ductility (% passing) | 83 | 50 |
| Spray Efficiency (%) | 78 | 72 |

As can be seen from Table III the microhardness, the spray efficiency and the ductility based on a cup test were better for the coarser powder.

EXAMPLES XVIII–XIX

Two free standing plasma sprayed coatings were produced by spraying a −150 mesh powder onto an aluminum substrate and subsequently dissolving the aluminum substrate. The free standing coatings were then corrosion tested in 10% $H_2SO_4$ at 50° C. The corrosion rates are set forth in Table IV.

TABLE IV

| Alloy | Corrosion Rate mils/yr |
|---|---|
| $Ni_{56.5}Mo_{23.5}Fe_{10}B_{10}$ | 16 |
| $Ni_{56.5}Mo_{23.5}Cr_{10}B_{10}$ | 8 |

What we claim is:

1. An amorphous metal powder for deposit onto a substrate consisting essentially of the formulation:

$(Fe,Ni,Co)_{bal}Cr_{0-20}(Mo,W,Mn)_{0-35}(B,Si,C)_{5-25}(Al,Ti)_{0-10}$ where the subscripts are in atomic percent and with the provisos that the B content is between 4 and 15 atomic percent, the Cr content is between 5 and 10 atomic percent, the Si content is at least 5 atomic percent and bal exceeds 50%, said powder being in fragmentized-ribbon platelet form and having a mesh size of −170 Tyler mesh.

2. The powder of claim 1 wherein at least 50% of said powder has a particle size greater than +270 Tyler mesh.

3. The powder of claim 1 wherein at least 50% of said powder has a particle size greater than +270 Tyler mesh.

4. A method for hardfacing a metal surface comprising the steps of:

selecting a fragmentized-ribbon platelet form of powder having a mesh size of −80 Tyler mesh and consisting essentially of the formulation:

$(Fe,Ni,Co)_{bal}Cr_{-20}(Mo,W,Mn)_{0-35}(B,Si,C)_{5-25}(Al,Ti)_{0-10}$ where the subscripts are in atomic percent and with the provisos that the B content is between 4 and 15 atomic percent and that bal exceeds 50%;

passing said powder through a flame spray torch or an arc plasma torch;

and depositing said powder onto a metal substrate.

5. The method of claim 4 wherein said powder has a mesh size of −170 Tyler mesh.

6. The method of claim 5 wherein the powder size is furter restricted such that at least 50% of said powder has a particle size greater than 270 Tyler mesh.

7. The method of claim 6 further comprising the step of:

grit blasting and degreasing said metal substrate before depositing said powder.

* * * * *

UNITED STATES PATENT AND TRADEMARK OFFICE

CERTIFICATE OF CORRECTION

PATENT NO. : 4,503,085

DATED : March 5, 1985

INVENTOR(S) : James Dickson et al.

It is certified that error appears in the above-identified patent and that said Letters Patent are hereby corrected as shown below:

Col. 8, line 5, "$(Fe,Ni,Co)_{bal}Cr_{-20}$..." should read "$(Fe,Ni,Co)_{bal}Cr_{0-20}$..."

Signed and Sealed this

*Sixth* Day of *May 1986*

[SEAL]

*Attest:*

DONALD J. QUIGG

*Attesting Officer*

*Commissioner of Patents and Trademarks*